US010823377B1

(12) United States Patent
Hsu

(10) Patent No.: US 10,823,377 B1
(45) Date of Patent: Nov. 3, 2020

(54) GROUND INSERT LAMP WITH ADJUSTABLE FOCUS AND ADJUSTABLE COLOR TEMPERATURE

(71) Applicant: Dong Guan Jia Sheng Lighting Technology Co., Ltd. China, Dong-Guna (CN)

(72) Inventor: Kevin Hsu, Taichung (TW)

(73) Assignee: Dong Guan Jia Sheng Lighting Technology Co., Ltd. China, Guang-Dong (CN)

( * ) Notice: Subject to any disclaimer, the term of this patent is extended or adjusted under 35 U.S.C. 154(b) by 0 days.

(21) Appl. No.: 16/659,769

(22) Filed: Oct. 22, 2019

(51) Int. Cl.
*F21V 21/08* (2006.01)
*F21V 21/116* (2006.01)
*F21V 19/02* (2006.01)

(52) U.S. Cl.
CPC ..... *F21V 21/0824* (2013.01); *F21V 19/02* (2013.01); *F21V 21/116* (2013.01)

(58) Field of Classification Search
CPC .... F21V 21/0824; F21V 21/116; F21V 19/02; F21L 4/04
See application file for complete search history.

(56) References Cited

U.S. PATENT DOCUMENTS 3,104,064 A * 9/1963 Bellek ..... F21V 21/0824 362/267
5,086,379 A * 2/1992 Denison ..... F21S 8/081 248/289.11
5,249,109 A * 9/1993 Denison ..... F21V 14/02 362/153.1
7,063,553 B1 * 6/2006 Mullen ..... F21V 19/006 439/336
9,857,061 B1 * 1/2018 Deng ..... F21V 5/004
10,024,506 B2 * 7/2018 Toner ..... F21S 9/032
2009/0040774 A1 * 2/2009 Avila ..... F21V 21/28 362/371
2011/0012534 A1 * 1/2011 West ..... F21V 23/0492 315/307
2015/0131288 A1 * 5/2015 Zhang ..... F21V 5/008 362/277
2015/0159842 A1 * 6/2015 Zhang ..... F21V 5/04 362/231
2015/0211720 A1 * 7/2015 Toner ..... G09F 13/02 362/183
2017/0167695 A1 * 6/2017 Erdener ..... F21S 8/081
2017/0276337 A1 * 9/2017 Thomas ..... F21V 15/01

* cited by examiner

*Primary Examiner* — William N Harris
(74) *Attorney, Agent, or Firm* — Alan D. Kamrath; Karin L. Williams; Mayer & Williams PC

(57) ABSTRACT

A ground insert lamp includes a ground insert and a lighting assembly detachably mounted on the ground insert. The lighting assembly includes a lamp body, a light source module, and a focus regulating module. The lamp body has a fixed portion that is rotatable relative to the ground insert. The lamp body includes a primary shell and a regulating shell. The light source module is mounted in the primary shell. The focus regulating module includes a plane mirror, a convex mirror, and a reflective mirror. The reflective mirror is mounted in the primary shell. The plane mirror is mounted in the primary shell. The convex mirror is mounted in and moved with the regulating shell, to adjust the distance between the convex mirror and the reflective mirror.

6 Claims, 5 Drawing Sheets

GROUND INSERT LAMP WITH ADJUSTABLE FOCUS AND ADJUSTABLE COLOR TEMPERATURE

BACKGROUND OF THE INVENTION

1. Field of the Invention

The present invention relates to a lamp and, more particularly, to a ground insert lamp.

2. Description of the Related Art

A conventional ground insert lamp comprises a ground insert and a lighting assembly mounted on the ground insert. The lighting assembly includes a lampshade, a light source, and a support pole. Thus, the ground insert lamp provides an illuminating function. However, the lighting assembly is secured on and cannot be rotated relative to the ground insert, such that the angle and the light output direction of the lighting assembly cannot be adjusted freely. In addition, the conventional ground insert lamp has a fixed light output face, a fixed focus, and a fixed color temperature that are fixed and cannot be adjusted according to the practical requirement, thereby limiting the versatility of the conventional ground insert lamp.

BRIEF SUMMARY OF THE INVENTION

The primary objective of the present invention is to provide a ground insert lamp with adjustable focus and adjustable color temperature.

In accordance with the present invention, there is provided a ground insert lamp comprising a ground insert and a lighting assembly detachably mounted on and rotatable relative to the ground insert. The lighting assembly includes a lamp body, a light source module mounted on the lamp body, and a focus regulating module mounted on the lamp body. The lamp body has a bottom provided with a fixed portion that is movably mounted on and rotatable relative to the ground insert. The lamp body includes a primary shell and a regulating shell movably mounted on the primary shell. The primary shell has an outer surface provided with two regulating slots which extend longitudinally. The ground insert lamp further comprises two movable adjusting members mounted in the two regulating slots of the primary shell. The light source module is mounted in the primary shell. The focus regulating module includes a plane mirror, a convex mirror, and a reflective minor. The reflective minor is mounted in the primary shell and located outside of the light source module. The plane mirror is mounted in the primary shell and located outside of the reflective minor. The convex minor is mounted in the regulating shell. The regulating shell is moved relative to the primary shell along the two regulating slots, and the convex mirror is moved in concert with the regulating shell, to adjust a distance between the convex minor and the reflective minor, so as to adjust a focus of the convex mirror.

According to the primary advantage of the present invention, the ground insert lamp has functions of focus adjustment and color temperature regulation, thereby enhancing the versatility thereof.

According to another advantage of the present invention, the lighting assembly is rotated relative to the ground insert, to adjust the angle of the lighting assembly freely.

Further benefits and advantages of the present invention will become apparent after a careful reading of the detailed description with appropriate reference to the accompanying drawings.

BRIEF DESCRIPTION OF THE SEVERAL VIEWS OF THE DRAWING(S)

DETAILED DESCRIPTION OF THE INVENTION

Figure 1:
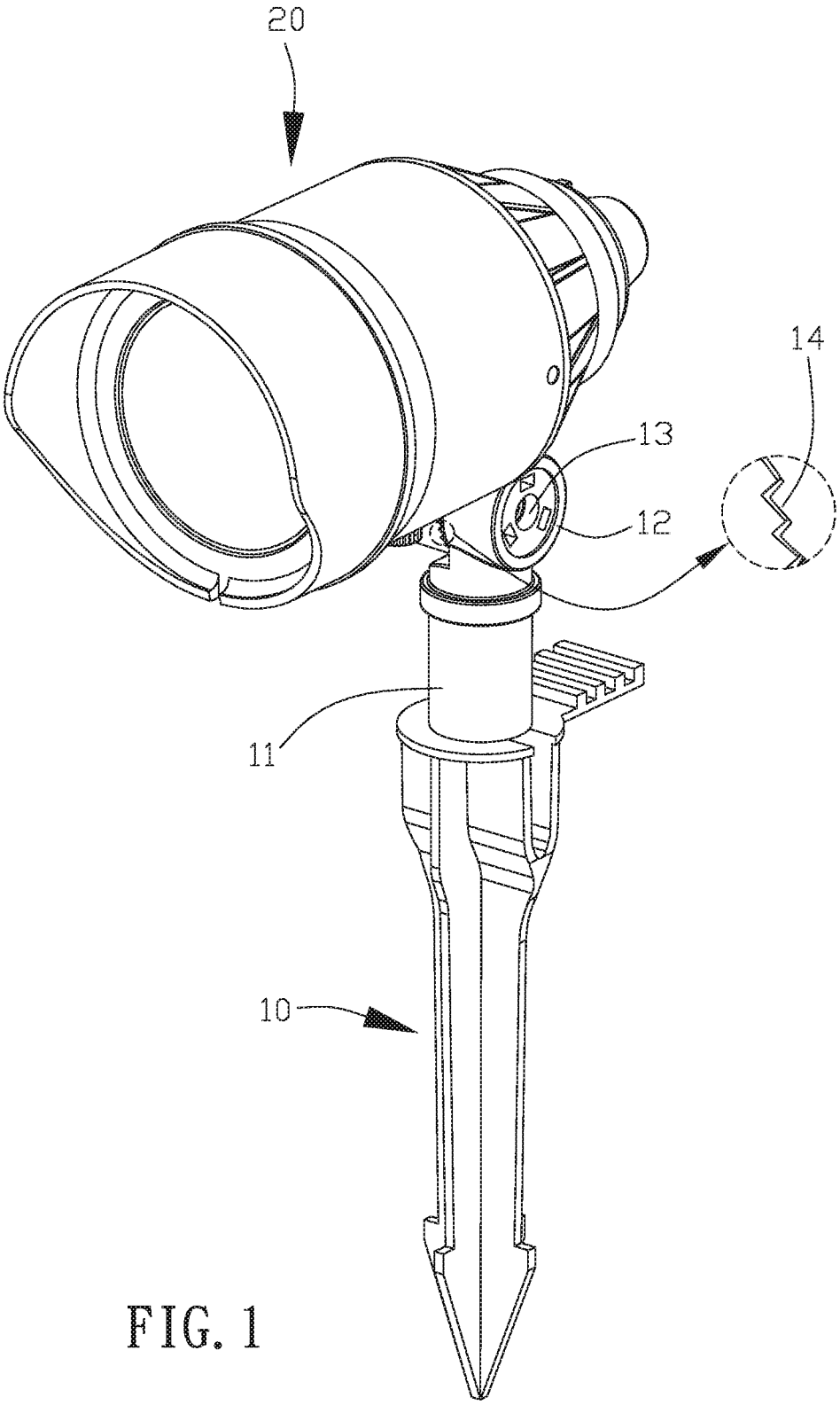
FIG. 1 is a perspective view of a ground insert lamp in accordance with the preferred embodiment of the present invention.
Figure 2:
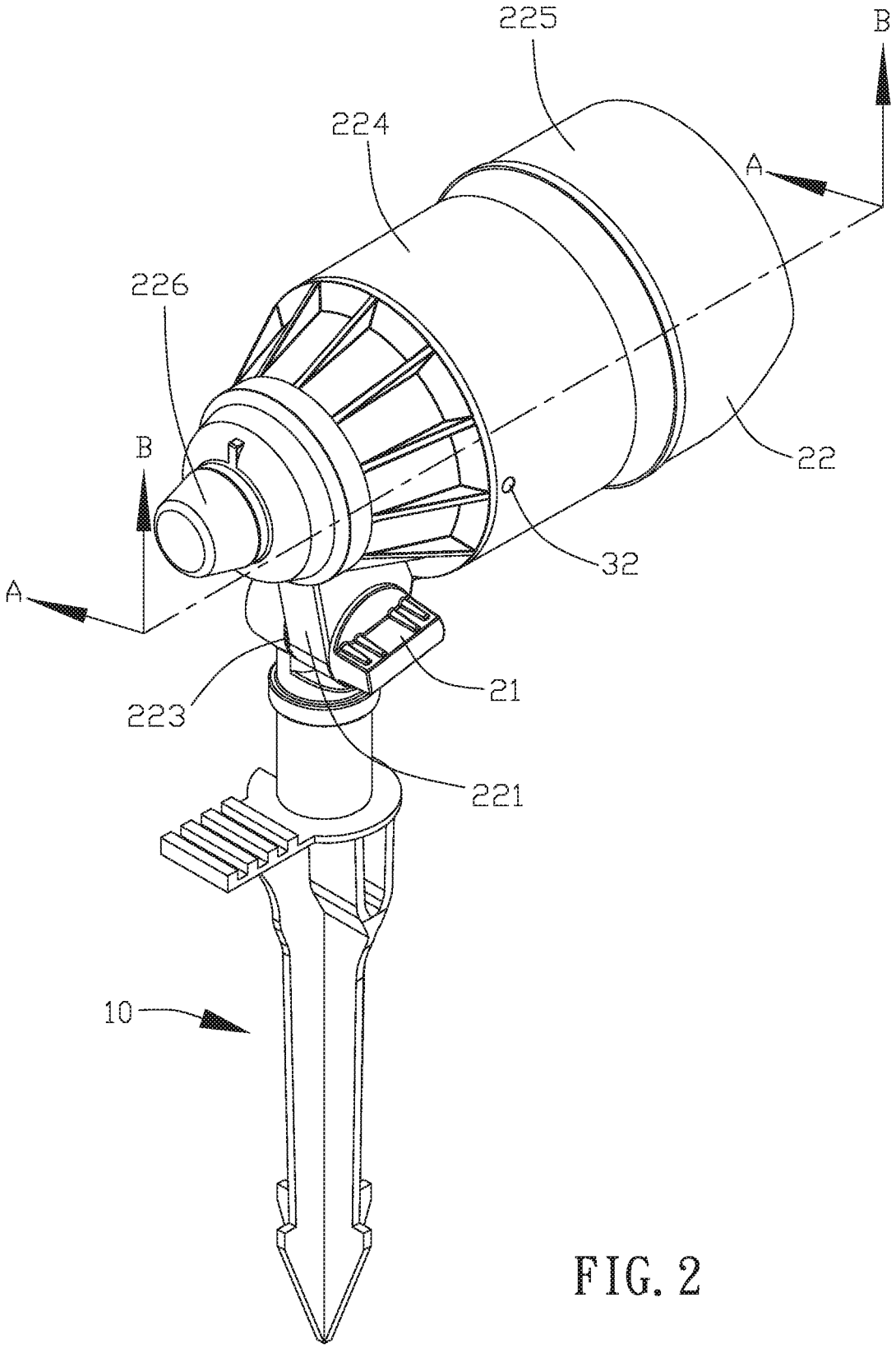
FIG. 2 is another perspective view of the ground insert lamp in accordance with the preferred embodiment of the present invention.
Figure 3:
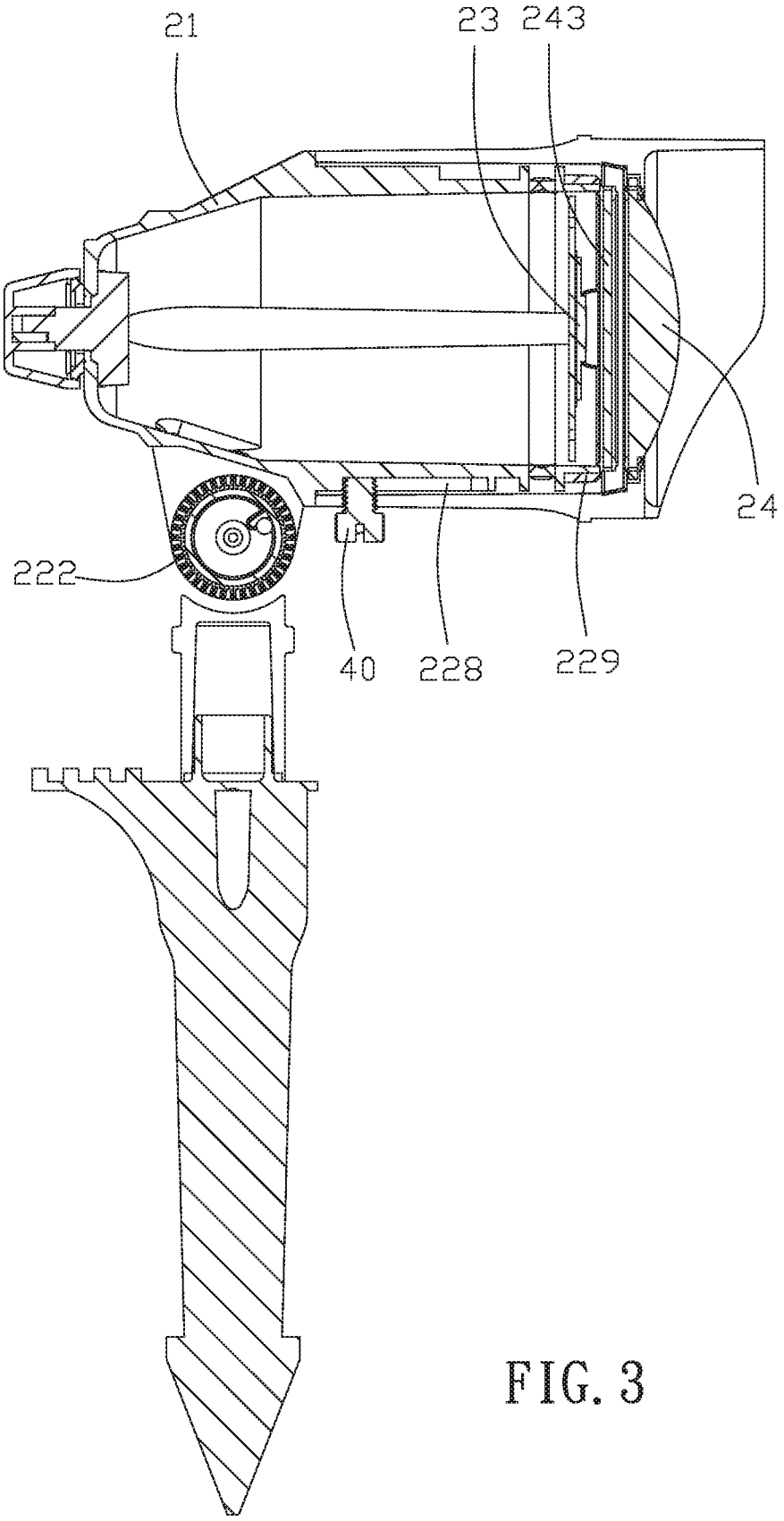
FIG. 3 is a cross-sectional view of the ground insert lamp taken along line A-A as shown in FIG. 2.
Figure 4:
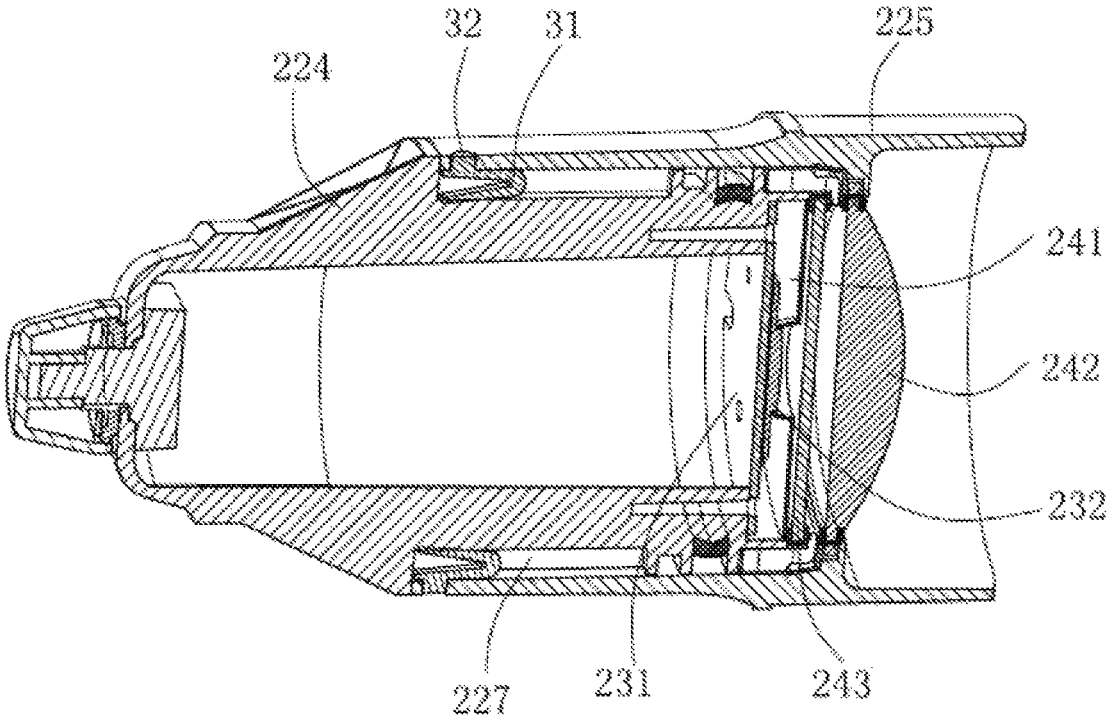
FIG. 4 is a cross-sectional view of the ground insert lamp taken along line B-B as shown in FIG. 2.
Figure 5:
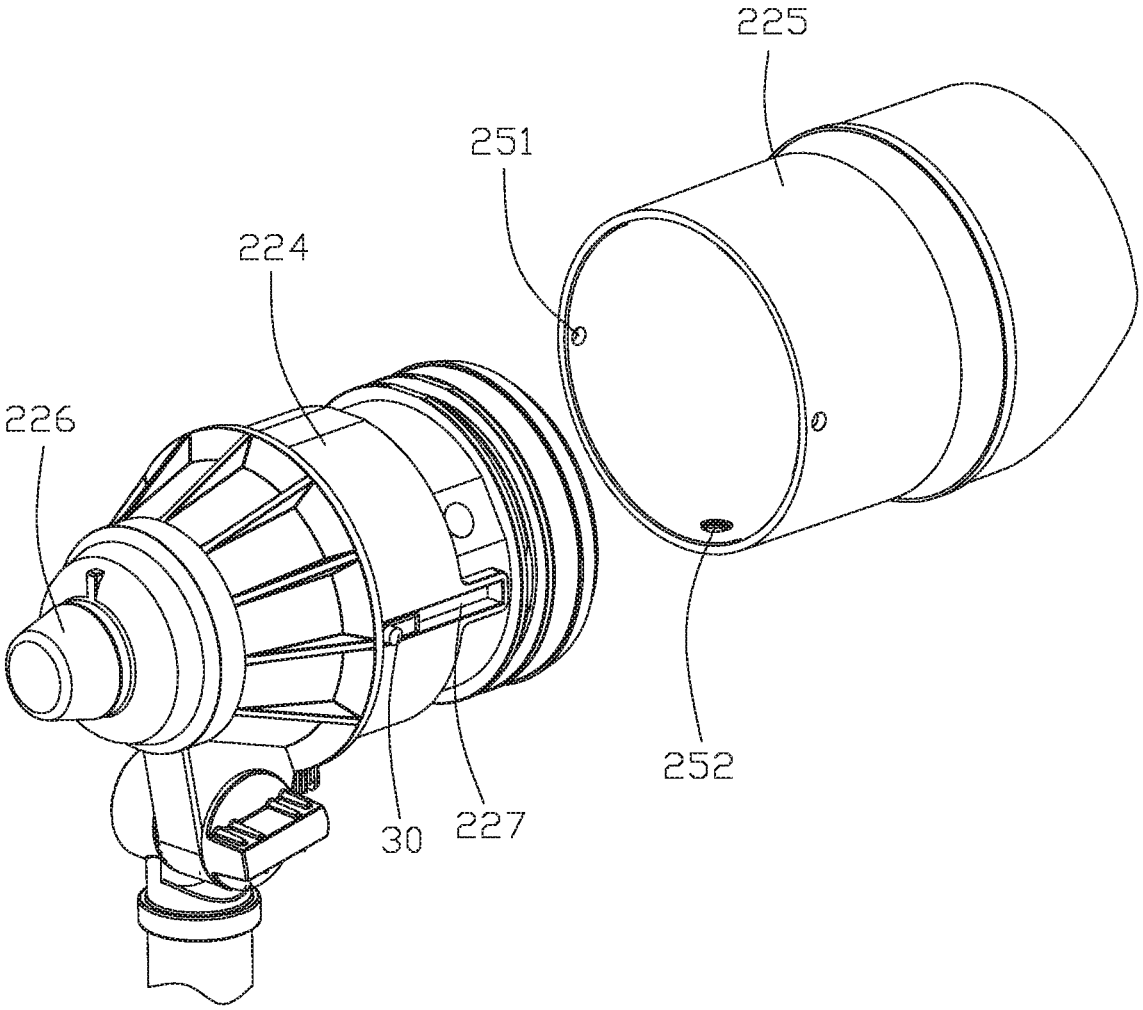
FIG. 5 is a partial exploded perspective view of the ground insert lamp in accordance with the preferred embodiment of the present invention.

Referring to FIGS. 1-5, a ground insert lamp in accordance with the preferred embodiment of the present invention comprises a ground insert 10 and a lighting assembly 20 detachably mounted on and rotatable relative to the ground insert 10.

The lighting assembly 20 includes a lamp body 22, a light source module 23 mounted on the lamp body 22, and a focus regulating module 24 mounted on the lamp body 22.

The lamp body 22 has a bottom provided with a fixed portion 221 that is movably mounted on and rotatable relative to the ground insert 10. The lamp body 22 includes a primary shell 224 and a regulating shell 225 movably mounted on the primary shell 224 and movable longitudinally relative to the primary shell 224. The regulating shell 225 is located at a front end of the primary shell 224, and a rear shell 226 is located at a rear end of the primary shell 224. The fixed portion 221 of the lamp body 22 is formed on a bottom of the primary shell 224. The primary shell 224 has an outer surface provided with two regulating slots 227 which extend longitudinally and are arranged symmetrically. The ground insert lamp further comprises two movable adjusting members 30 mounted in the two regulating slots 227 of the primary shell 224. The two movable adjusting members 30 are moved forward and backward in the two regulating slots 227 of the primary shell 224.

The light source module 23 is mounted in the primary shell 224.

The focus regulating module 24 includes a plane mirror 241, a convex mirror (or lens) 242, and a reflective mirror (or reflector) 243. The reflective mirror 243 is mounted in the primary shell 224 and located outside of the light source module 23. The plane mirror 241 is mounted in the primary shell 224 and located outside of the reflective mirror 243. The convex mirror 242 is mounted in the regulating shell 225. The regulating shell 225 is moved relative to the primary shell 224 along the two regulating slots 227, and the convex mirror 242 is moved in concert with the regulating shell 225, to adjust a distance between the convex mirror 242 and the reflective mirror 243, so as to adjust a focus of the convex mirror 242, thereby providing different irradiating angles.

In the preferred embodiment of the present invention, an end cap 229 is mounted on an end portion of the primary shell 224. The plane mirror 241 is mounted in the end cap 229 and located between the primary shell 224 and the end cap 229. A seal ring is mounted on a periphery of the plane mirror 241 and separates the plane mirror 241 from the reflective mirror 243. The seal ring is located the plane mirror 241 and the end cap 229, such that the plane mirror 241 is mounted in the end cap 229 tightly, closely and steadily.

In the preferred embodiment of the present invention, the regulating shell 225 is provided with an annular mounting recess for mounting the convex mirror 242. A seal ring is mounted between the regulating shell 225 and the convex mirror 242. A buffering washer is mounted between the regulating shell 225 and the end cap 229. The regulating shell 225 has an end portion arranged irregularly and formed with a light output opening to increase a downward light output area.

In the preferred embodiment of the present invention, the ground insert 10 has a top provided with a mounting portion 12 which has a side provided with a scaled toothed disk 14. The fixed portion 221 of the lamp body 22 has a side provided with an adjusting toothed disk 223 engaging the scaled toothed disk 14 of the ground insert 10. Preferably, the mounting portion 12 is formed on a top of a mounting member 11 which is threadedly connected with the top of the ground insert 10. The mounting portion 12 is provided with a mounting hole 13 which transversely penetrates the mounting portion 12.

In the preferred embodiment of the present invention, the fixed portion 221 of the lamp body 22 is provided with a fixing hole 222 which transversely penetrates the fixed portion 221. The adjusting toothed disk 223 is formed in the fixing hole 222 of the lamp body 22.

In the preferred embodiment of the present invention, a screw member 21 extends through the fixed portion 221 of the lamp body 22 and the ground insert 10, such that the fixed portion 221 of the lamp body 22 is mounted on the ground insert 10. Thus, the lighting assembly 20 is mounted on the mounting portion 12 of the ground insert 10 by the screw member 21, and is arranged between the screw member 21 and the mounting member 11 of the ground insert 10. The fixed portion 221 of the lamp body 22 is located between the screw member 21 and the mounting portion 12 of the ground insert 10. In such a manner, the screw member 21 and the mounting member 11 of the ground insert 10 are used to mount and position the lighting assembly 20. In addition, the lighting assembly 20 is driven and rotated by the screw member 21 to rotate relative to the ground insert 10.

In the preferred embodiment of the present invention, the regulating shell 225 is provided with a positioning hole 252. The primary shell 224 is provided with an elongated positioning channel 228. Preferably, the elongated positioning channel 228 of the primary shell 224 extends in a direction and has a length the same as that of the two regulating slots 227. A positioning screw 40 is mounted on the lamp body 22. The positioning screw 40 extends through the positioning hole 252 of the regulating shell 225 into the elongated positioning channel 228 of the primary shell 224, and presses a wall of the elongated positioning channel 228, to position the regulating shell 225 on the primary shell 224.

In the preferred embodiment of the present invention, the primary shell 224 is provided with a limit portion, and the light source module 23 is mounted on an outside of the limit portion. The light source module 23 includes a circuit board 231 mounted on the outside of the limit portion, and an LED light source 232 mounted on an outside of the circuit board 231. The reflective mirror 243 is mounted on an outside of the LED light source 232.

In the preferred embodiment of the present invention, the reflective mirror 243 includes an annular extension, and a central portion extending outward from a periphery of a middle of the annular extension. The central portion of the reflective mirror 243 surrounds the outside of the LED light source 232 and corresponds to a light emitting portion of the LED light source 232.

In the preferred embodiment of the present invention, the ground insert lamp further comprises a color temperature regulating device mounted in the primary shell 224.

In the preferred embodiment of the present invention, the regulating shell 225 is provided with two adjusting holes 251. Each of the two movable adjusting members 30 includes a base 31 movably mounted in one of the two regulating slots 227 of the primary shell 224, and a positioning knob 32 mounted on the base 31 and extending into one of the two adjusting holes 251 of the regulating shell 225. The base 31 of each of the two movable adjusting members 30 is a preferably a substantially V-shaped elastic plate.

In operation, the lighting assembly 20 is pulled outward by the screw member 21, to disengage the adjusting toothed disk 223 of the lamp body 22 from the scaled toothed disk 14 of the ground insert 10. Then, the lighting assembly 20 is driven by the screw member 21 and rotated to a required angle. Then, the lighting assembly 20 is pushed inward by the screw member 21, to engage the adjusting toothed disk 223 of the lamp body 22 with the scaled toothed disk 14 of the ground insert 10, such that the lighting assembly 20 is secured on the ground insert 10. Thus, the lighting assembly 20 is rotated relative to the ground insert 10, to adjust the angle of the lighting assembly 20 freely.

In addition, the positioning screw 40 is unscrewed from the positioning hole 252 of the regulating shell 225, and detached from the wall of the elongated positioning channel 228, to unlock the regulating shell 225 from the primary shell 224, such that the regulating shell 225 is moved freely. In such a manner, the regulating shell 225 is moved relative to the primary shell 224 by guidance of the two movable adjusting members 30 which are moved in the two regulating slots 227 of the primary shell 224. Thus, the regulating shell 225 is moved to change the distance between the convex mirror 242 and the reflective mirror 243, so as to achieve the purpose of focus adjustment.

In addition, the color temperature regulating device is arranged on the light source module 23, and the lamp body 22 is provided with push buttons. Thus, the user adjusts the color temperature by pressing the push buttons or by an APP of a cell phone.

Accordingly, the ground insert lamp has functions of focus adjustment and color temperature regulation, thereby enhancing the versatility thereof. In addition, the lighting assembly 20 is rotated relative to the ground insert 10, to adjust the angle of the lighting assembly 20 freely.

Although the invention has been explained in relation to its preferred embodiment(s) as mentioned above, it is to be understood that many other possible modifications and variations can be made without departing from the scope of the present invention. It is, therefore, contemplated that the appended claim or claims will cover such modifications and variations that fall within the scope of the invention.

The invention claimed is:

1. A ground insert lamp comprising:

a ground insert and a lighting assembly detachably mounted on and rotatable relative to the ground insert; wherein:

the lighting assembly includes a lamp body, a light source module mounted on the lamp body, and a focus regulating module mounted on the lamp body;

the lamp body has a bottom provided with a fixed portion that is movably mounted on and rotatable relative to the ground insert;

the lamp body includes a primary shell and a regulating shell movably mounted on the primary shell;

the primary shell has an outer surface provided with two regulating slots which extend longitudinally;

the ground insert lamp further comprises two movable adjusting members mounted in the two regulating slots of the primary shell;

the light source module is mounted in the primary shell;

the focus regulating module includes a plane mirror, a convex mirror, and a reflective mirror;

the reflective mirror is mounted in the primary shell and located outside of the light source module;

the plane mirror is mounted in the primary shell and located outside of the reflective mirror;

the convex mirror is mounted in the regulating shell;

the regulating shell is moved relative to the primary shell along the two regulating slots; and the convex mirror is moved in concert with the regulating shell, to adjust a distance between the convex mirror and the reflective mirror, so as to adjust a focus of the convex mirror.

2. The ground insert lamp of claim 1, wherein:

an end cap is mounted on an end portion of the primary shell; and the plane mirror is located between the primary shell and the end cap.

3. The ground insert lamp of claim 1, wherein the ground insert has a top provided with a mounting portion which has a side provided with a scaled toothed disk, and the fixed portion of the lamp body has a side provided with an adjusting toothed disk engaging the scaled toothed disk of the ground insert.

4. The ground insert lamp of claim 1, wherein:

a screw member extends through the fixed portion of the lamp body and the ground insert;

the fixed portion of the lamp body is located between the screw member and the ground insert; and the lighting assembly is driven and rotated by the screw member to rotate relative to the ground insert.

5. The ground insert lamp of claim 1, wherein:

the regulating shell is provided with a positioning hole;

the primary shell is provided with an elongated positioning channel;

a positioning screw is mounted on the lamp body; and the positioning screw extends through the positioning hole of the regulating shell into the elongated positioning channel of the primary shell, and presses a wall of the elongated positioning channel.

6. The ground insert lamp of claim 1, wherein:

the light source module includes a circuit board mounted on an outside of the primary shell, and an LED light source mounted on an outside of the circuit board; and the reflective mirror is mounted on an outside of the LED light source.

* * * * *